US011159890B2

(12) United States Patent
Zhang et al.

(10) Patent No.: US 11,159,890 B2
(45) Date of Patent: Oct. 26, 2021

(54) ACOUSTIC RECEIVER

(71) Applicant: Knowles Electronics, LLC, Itasca, IL (US)

(72) Inventors: Yahui Zhang, Schaumburg, IL (US); Shehab Albahri, Hanover Park, IL (US); Christopher Gabel, Bloomingdale, IL (US)

(73) Assignee: Knowles Electronics, LLC, Itasca, IL (US)

( * ) Notice: Subject to any disclaimer, the term of this patent is extended or adjusted under 35 U.S.C. 154(b) by 76 days.

(21) Appl. No.: 16/657,923

(22) Filed: Oct. 18, 2019

(65) Prior Publication Data

US 2021/0120341 A1 Apr. 22, 2021

(51) Int. Cl.

| | |
|---|---|
| ***H04R 9/02*** | (2006.01) |
| ***H04R 9/06*** | (2006.01) |
| ***H04R 31/00*** | (2006.01) |
| ***H04R 7/18*** | (2006.01) |

(52) U.S. Cl.

CPC ..... *H04R 9/06* (2013.01); *H04R 7/18* (2013.01); *H04R 9/025* (2013.01); *H04R 31/006* (2013.01)

(58) Field of Classification Search

CPC . H04R 9/06; H04R 9/025; H04R 7/18; H04R 31/006

See application file for complete search history.

(56) References Cited

U.S. PATENT DOCUMENTS

| | | | | |
|---|---|---|---|---|
| 3,935,398 A | 1/1976 | Carlson et al. | | |
| 5,690,093 A | 11/1997 | Schrank et al. | | |
| 6,757,403 B2 * | 6/2004 | Urushibata | H04R 9/046 | 381/412 |
| 7,706,561 B2 * | 4/2010 | Wilmink | H04R 31/006 | 381/398 |
| 2006/0140436 A1 * | 6/2006 | de Moel | H04R 31/006 | 381/396 |
| 2006/0239488 A1 | 10/2006 | Geschiere et al. | | |
| 2012/0008814 A1 | 1/2012 | Alwicker et al. | | |
| 2012/0286865 A1 | 11/2012 | Chandrasekaran | | |
| 2014/0369548 A1 | 12/2014 | Manley et al. | | |
| 2015/0036831 A1 | 2/2015 | Klippel | | |

(Continued)

FOREIGN PATENT DOCUMENTS

| | | |
|---|---|---|
| CN | 204350285 U | 5/2015 |
| CN | 205596313 U | 9/2016 |

(Continued)

OTHER PUBLICATIONS

European Patent Office; International Search Report and Written Opinion; International Application No. PCT/US2018/041921; dated Feb. 15, 2019.

(Continued)

*Primary Examiner* — Brian Ensey

(74) *Attorney, Agent, or Firm* — Faegre Drinker Biddle & Reath LLP

(57) ABSTRACT

An acoustic receiver includes a first receiver subassembly having a bottom housing plate with a motor assembly fastened thereto, and a second receiver subassembly having a closed-ended receiver housing sidewall fastened to the bottom housing plate that includes at least one sidewall opening where a portion of the acoustic receiver is disposed in the at least one sidewall opening.

22 Claims, 5 Drawing Sheets

(56) References Cited

U.S. PATENT DOCUMENTS

| | | | | |
|---|---|---|---|---|
| 2015/0249889 | A1 | 9/2015 | Iyer et al. | |
| 2015/0373456 | A1* | 12/2015 | Dayton ..... | H04R 7/18<br>381/398 |
| 2016/0227328 | A1 | 8/2016 | Van Halteren et al. | |
| 2019/0238994 | A1 | 8/2019 | King | |
| 2020/0213788 | A1 | 7/2020 | Albahri | |

FOREIGN PATENT DOCUMENTS

| | | | |
|---|---|---|---|
| CN | 107135449 | A | 9/2017 |
| CN | 107222818 | A | 9/2017 |
| CN | 206775740 | U | 12/2017 |
| CN | 206879090 | U | 1/2018 |
| CN | 207354540 | U | 5/2018 |
| GB | 859830 | A | 1/1961 |
| WO | 2015/057519 | A1 | 4/2015 |
| WO | 2016/058637 | A1 | 4/2016 |
| WO | 2019/014510 | A2 | 1/2019 |

OTHER PUBLICATIONS

European Patent Office; International Search Report and Written Opinion; International Application No. PCT/US2017/056873; dated Mar. 19, 2018.

* cited by examiner

ACOUSTIC RECEIVER

TECHNICAL FIELD

The disclosure relates generally to acoustic receivers and more specifically to acoustic receiver comprising a closed-ended sidewall housing subassembly.

BACKGROUND

Hearing devices such as hearing aids, headphones, and earbuds among others commonly include sound-producing moving armature receivers. Such receivers generally comprise a housing containing a diaphragm that separates the housing into front and back volumes, and a motor disposed in the back volume for driving the diaphragm via an interconnecting link. An electrical signal applied to a coil of the motor causes the reed to move between magnets retained by a yoke. Movement of the reed in turn causes movement of a diaphragm within the housing and the corresponding emission of sound from a sound port.

The housing of known acoustic armature receivers includes a multi-sided bottom cup containing the motor and diaphragm, and a top cup disposed over the bottom cup. The top and bottom cups are formed in drawing operations that are costly to manufacture and laborious to assemble.

Figure 2:
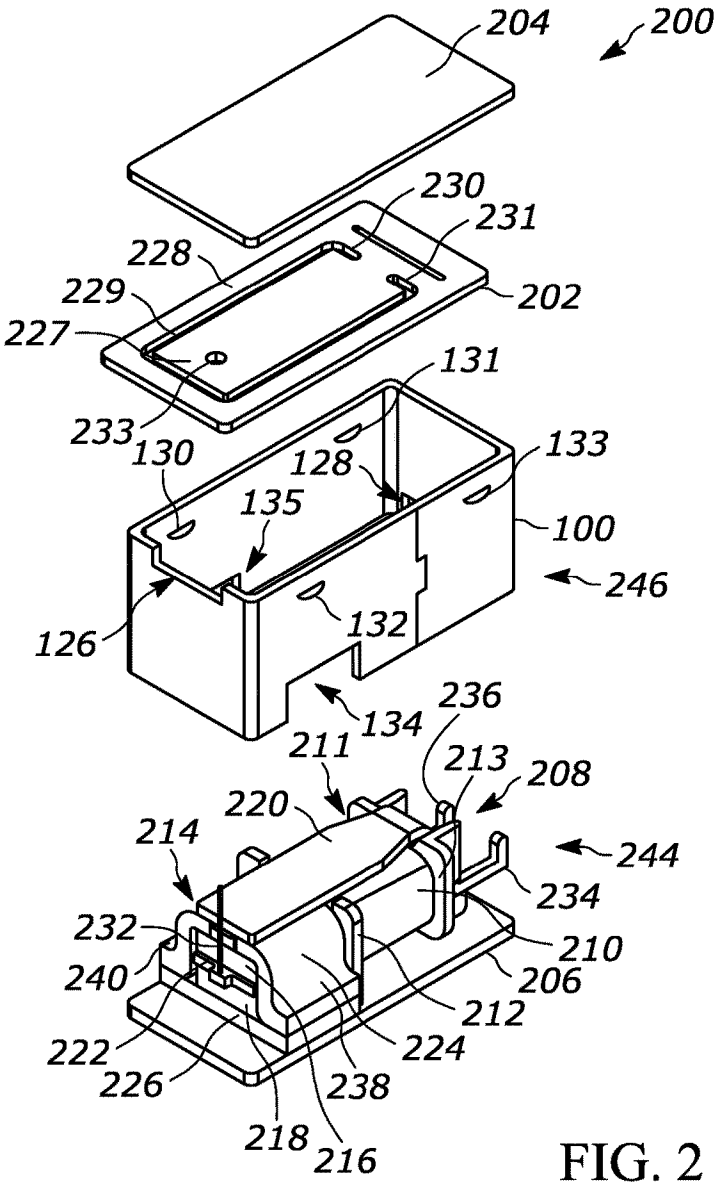
FIG. 2 is an assembly view of an acoustic receiver in accordance with one example.

Those of ordinary skill in the art will appreciate that elements in the figures are illustrated for simplicity and clarity. It will be further appreciated that certain actions or steps may be described or depicted in a particular order of occurrence while those of ordinary skill in the art will understand that such specificity with respect to sequence is not actually required unless a particular order is specifically indicated. It will also be understood that the terms and expressions used herein have the ordinary meaning as is accorded to such terms and expressions with respect to their corresponding respective fields of inquiry and study except where specific meanings have otherwise been set forth herein.

DETAILED DESCRIPTION

The disclosure is drawn generally to acoustic receivers that include separate receiver subassemblies. A first receiver subassembly includes a motor disposed on a bottom housing plate. The motor includes a coil, a yoke that retains first and second magnets, and a reed with a portion located adjacent the coil and a portion extending between the magnets. A second receiver subassembly includes a closed-ended housing sidewall having a first open end. The bottom housing plate covers the first open end to form at least a portion of a receiver housing such that the closed-ended housing sidewall is disposed about the motor. The closed-ended housing sidewall includes one or more sidewall openings. In some embodiments, a first sidewall opening is disposed through a first sidewall portion of the closed-ended housing sidewall. In other embodiments a second sidewall opening is disposed through a second sidewall portion of the closed-ended housing sidewall. A diaphragm located in the receiver housing separates an interior of the receiver housing into a front volume and a back volume, with the motor being disposed in the back volume. The reed is coupled to the diaphragm by a link, like a drive rod, and is movable between the first and second magnets in response to an excitation signal applied to the coil.

In one embodiment, one or more sidewall openings are formed at a bottom edge of the closed-ended housing sidewall, where the bottom edge is proximate to the bottom housing plate. In some examples, each of the sidewall openings receive a corresponding portion of the yoke.

In another embodiment, one or more sidewall openings are formed at a top edge of the closed-ended housing sidewall. The closed-ended housing sidewall also includes a second open end opposite a first open end. A top housing plate or cover is fastened to the second open end. A portion of the top housing plate is disposed in a corresponding sidewall opening. In some examples, the top housing plate includes multiple tabs that are disposed in corresponding sidewall openings.

In still another embodiment, one or more sidewall openings are formed at a bottom edge of the closed-ended housing sidewall, wherein the bottom edge is proximate to the bottom housing plate. In some examples, the one or more sidewall openings receive corresponding portions of a bobbin.

According to another aspect of the disclosure, a close-ended housing sidewall subassembly for an acoustic receiver comprises a single strip of metal with a first end and a second end coupled by a joint. A sidewall opening disposed through a portion of the closed-ended receiver housing sidewall receives a portion of an acoustic receiver when the sidewall subassembly is integrated with other components of the acoustic receiver. In one some embodiments, diaphragm-support projections protrude from an inside surface of the closed-ended receiver housing sidewall. An acoustical port is disposed through another portion the closed-ended housing sidewall such that the acoustical port is disposed on one side of the diaphragm-support projections and a lead pass-through opening is disposed on an opposite side of the diaphragm-support projections.

In one embodiment, one or more sidewall openings formed at a bottom edge of the closed-ended housing sidewall are configured to receive corresponding portions of a yoke when the sidewall subassembly is integrated with another subassembly including the yoke.

In another embodiment, one or more sidewall openings formed at a top edge of the closed-ended housing sidewall are configured to receive corresponding portions of a top housing plate when the sidewall subassembly is integrated with the top housing plate.

In still another embodiment, one or more sidewall openings formed at a bottom edge of the closed-ended housing sidewall configured to receive corresponding portions of a bobbin when the sidewall subassembly is integrated with another subassembly that includes the bobbin.

According to yet another aspect, an acoustic receiver housing sidewall subassembly includes a closed-ended sidewall having first, second, third and fourth sidewall portions. The closed-ended sidewall includes a top edge and a bottom edge, wherein the top edge defines an open top portion and the bottom edge defines an open bottom portion. A diaphragm-support structure is disposed on the closed-ended sidewall between the top and bottom edges. An acoustical port is disposed through one of the sidewall portions of the closed-ended sidewall and another opening is disposed through a sidewall portion other than the sidewall portion having the acoustical port. The other opening is configured to receive a portion of a component of another subassembly when the other subassembly is integrated with the sidewall subassembly.

In implementations of the embodiments described herein, the closed-ended sidewall is formed of a strip of material (metal or non-metal) having opposite ends that are coupled by a joint (e.g., a single joint or multiple butt joints). The first, second, third and fourth sidewall portions are partly defined by folds in the strip of material.

In one embodiment, the acoustical port is located between the top edge and the diaphragm-support structure, while the opening is located between the bottom edge and the diaphragm-support structure. The opening is configured to receive a portion of a motor of the acoustic receiver when the subassembly is integrated with the motor. Also, a lead pass-through opening is disposed through a sidewall portion opposite the sidewall portion having the acoustical port, where the acoustical port and the lead pass-through opening are located between the top edge and the diaphragm-support structure.

In another embodiment, the acoustical port and the opening are located between the top edge and the diaphragm-support structure. The opening is configured to receive a portion of a top housing plate when the subassembly is integrated with the top housing plate.

According to one approach, an acoustic receiver is made by assembling a first receiver subassembly with a second receiver subassembly. The first receiver subassembly is made by fastening a motor to a first housing cover, wherein a reed is located through a passage of the electrical coil such that a movable portion of the reed is disposed between first and second magnets of a yoke. The second receiver subassembly is a closed-ended housing sidewall having a plurality of sidewall openings that include a first sidewall opening disposed through a first sidewall portion and a second sidewall opening disposed through a second sidewall portion opposite the first sidewall portion.

In one embodiment, the first and second sidewall openings are formed by a bottom edge of the closed-ended housing sidewall. Each of the first and second sidewall openings has a width greater than a height of the openings such that the first and second sidewall openings are adapted to receive a portion of the yoke that protrudes into the first and second sidewall openings.

In another embodiment, the first sidewall portion includes at least a third sidewall opening and the second sidewall portion includes at least a fourth sidewall opening. The first, second, and at least third sidewall openings are formed by a top edge of the closed-ended housing sidewall and are adapted to support a second housing cover. The second housing cover includes a plurality of tabs that are adapted to engage the first, second, and at least third sidewall openings.

In still another embodiment, the first and second sidewall openings are formed by a bottom edge of the closed-ended housing sidewall. Each of the first and second sidewall openings has a height greater than a width of the openings such that the first and second sidewall openings are adapted to receive a portion of a bobbin that protrudes into the first and second sidewall openings.

Figure 1:
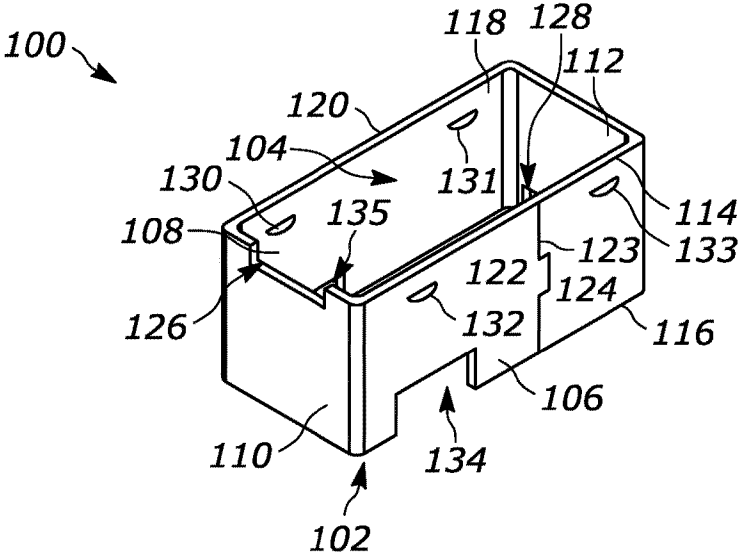
FIG. 1 is a perspective view of a portion of an acoustic receiver housing in accordance with one example.

The acoustic receiver generally comprises a housing including a closed-ended housing sidewall subassembly. In FIG. 1, a closed-ended housing sidewall 100 according to one embodiment is embodied as a strip of folded material (e.g., a strip of folded metal or non-metal) with an open bottom portion 102 (also referred to as a first open end), an open top portion 104 (also referred to as a second open end), a first sidewall portion 106, a second sidewall portion 108, a third sidewall portion 110, and a fourth sidewall portion 112. The sidewall portions are partly defined by folds in the strip of material. In other embodiments, the acoustic receiver housing may be embodied as a five-sided cup with only a single open portion, or as segments of tubular stock. Such tubular stock may be formed by extrusion or by a folded material having lengthwise seam.

The closed-ended housing sidewall includes a top edge 114, a bottom edge 116, an inside surface 118, and an outside surface 120. The top edge defines the open top portion 104 and the bottom edge defines the open bottom portion 102. The top edge includes an acoustical notch opening or port 126, while the bottom edge includes a lead pass-through opening or port 128.

In FIG. 1, the closed-ended housing sidewall includes a first end 122 and a second end 124 coupled by a joint 123 (e.g., a single joint, multiple butt joints, press fit tabs and notches, etc.). However, it will be recognized that any suitable securing mechanism may be employed including braising, blooming, or any other suitable mechanism for connecting the first end and the second end.

The closed-ended housing sidewall also includes a diaphragm-support structure. In FIG. 1, this structure is embodied as a plurality of diaphragm-support projections 130-133 located between the top edge 114 and the bottom edge 116. However, other support structures (e.g., an elongated shelf protruding from or fastened to two or more housing side walls) may be employed alternatively. The diaphragm-support structure is adapted to locate a diaphragm within the housing. In FIG. 1, the diaphragm-support projections 130-133 are formed by stamping the outside surface 120 such that the projections protrude on the inside surface 118. On the outside surface 120, these projections appear as recesses or indentations. While FIG. 1 shows four diaphragm-support projections located on the sidewall portions, any number, shape and configuration of diaphragm-support structure may be used in other embodiments.

The acoustical port 126 is located on a different sidewall portion than the lead pass-through opening 128. The acoustical port is disposed on one side of the diaphragm-support structure, and the lead pass-through opening is disposed on the other side of the diaphragm-support structure. The acoustical port is located between the top edge and the diaphragm-support structure. It will be recognized that the acoustical port and/or the lead pass-through opening can be placed at other locations on any of the sidewall portions.

The closed-ended housing sidewall generally includes one or more sidewall openings formed in one or more sidewall portions. FIG. 1 shows a plurality of sidewall openings including a first sidewall opening 134 disposed through the first sidewall portion 106 and a second sidewall opening 135 disposed through the second sidewall portion 108. In this example, the first and second sidewall openings 134, 135 are located between the bottom edge 116 and the diaphragm-support projections 130-133.

FIG. 2 illustrates an acoustic receiver 200 including a closed-ended housing sidewall 100, a diaphragm 202, and a top housing cover or plate 204. The acoustic receiver also includes a bottom housing cover or plate 206 and a motor 208 disposed on the bottom housing plate. The motor includes an electrical coil 210 disposed around a bobbin 211 with a first flanged section 212 and a second flanged section 213. However, in other embodiments, the coil does not include the bobbin. A yoke 214 retains a first magnet 216 and a second magnet 218 in spaced apart relation and a reed (or armature) 220 has a portion disposed through the coil and a portion that extends between the magnets.

In FIG. 2, the yoke 214 is an assembly including a strap portion 224 retaining the first magnet 216 and a magnet plate 226 retaining the second magnet 218. The magnet plate 226 is fastened to the bottom housing plate 206 by a weld, adhesive, crimped flanges, or some other fastening mechanism. The strap portion 224 may be welded to the magnet plate 226. In other embodiments, the yoke 214 is a stamped and folded structure with butt joined ends, or stacked closed-ended plates welded together, or a section of extruded tube stock, or any other suitable structure. The first and second magnets may be fastened to the yoke by a weld, adhesive, crimped flanges, or some other fastening mechanism. The reed 220 is a U-shaped reed with an end portion fastened to the yoke 214. In other embodiments, the reed 220 may be configured differently (e.g., an E-reed). The bottom housing plate 206 and the motor form a receiver subassembly 244.

The closed-ended housing sidewall 100 is fastened to the bottom housing plate 206 after the motor is disposed (e.g., welded) on the bottom housing plate. The closed-ended housing sidewall forms a second receiver subassembly 246. The first and second subassemblies 244, 246 are separate components assembled by coupling the bottom housing plate 206 to the open bottom portion (or first open end) 102 of the closed-ended housing sidewall 100. The top housing plate 204 is assembled to the open top portion (or second open end) 104 of the closed-ended housing sidewall after assembly of the diaphragm. The housing plates can be fastened to the closed-ended housing sidewall by one or more welds, adhesive, crimped flanges, or some other fastening mechanism. The closed-ended housing sidewall 100, the diaphragm 202, the top housing plate 204, and the bottom housing plate 206 including the motor are discrete elements that when assembled, form a receiver housing.

The diaphragm 202 is disposed and retained in the receiver housing before the top housing plate 204 is assembled. The diaphragm-support projections 130-133 locate and support the diaphragm. In one embodiment, the diaphragm is positioned on the projections 130-133 and fastened with an adhesive that forms a seal between the diaphragm and the sidewall.

The diaphragm 202 includes a paddle 227, a frame 228, and a gap 229 separating the paddle 227 and the frame 228. The diaphragm 202 further includes hinge members 230, 231 connecting the paddle 227 to the frame 228. In FIG. 2, the gap is generally U-shaped, and the hinge members are torsional hinge members that form torsion hinges disposed on opposite sides of the paddle. In other embodiments, the hinge members may be cantilever hinge members that form cantilever hinges disposed along a single side of the paddle. The gap may be covered by a urethane film (not shown) to form an air seal. When moved, the paddle 227 causes sound to emanate from the acoustical port 126. The diaphragm 202 may be made of a variety of materials (e.g., aluminum, nickel, copper, etc.) and fabricated from a single, unassembled member or formed as an assembly of separate parts.

A link interconnects a movable portion of the reed with a movable portion of the diaphragm. In FIG. 2, the link is a drive rod 232 attached to the movable part of the reed 220 and secured to an opening 233 within the paddle (e.g., by using adhesive). The opening is generally larger than the drive rod to facilitate alignment of the opening with the drive rod during assembly. Alternatively, the link may be embodied as a bent finger extending from the movable end of the reed, or as some other member fastened to the reed and paddle. In other embodiments, the link may extend from the movable part of the reed, through a gap between the coil and the yoke, or through a passage in the yoke, and then through a hole in the fixed part of the reed. The reed is moveable between the first and second magnets in response to an excitation signal applied to the coil via electrical leads 234, 236. The lead pass-through opening 128 allows the passage of the electrical leads and any other electronic components to the exterior of the receiver housing. Any openings around the electrical leads may be sealed with an acoustic sealant or other suitable material if an unvented back volume is desired.

In FIGS. 1 and 2, the first and second sidewall openings 134, 135 are formed at the bottom edge 116 of the closed-ended housing sidewall 100. The bottom edge 116 is proximate the bottom housing plate 206. Each of the first and second sidewall openings is configured to receive corresponding portions of the yoke. When assembled, the first and second sidewall openings 134, 135 receive corresponding flanged portions 238, 240 of the yoke that protrude into the first and second sidewall openings. Although FIG. 1 shows multiple openings, in some embodiments, a single opening may be employed depending on the structure of the yoke and/or other components of the acoustic receiver. Unlike prior designs, the sidewall openings in FIGS. 1-3 enable the use of a bigger yoke without the need to enlarge or resize the closed-ended housing sidewall 100 and may facilitate alignment during assembly. Other advantages will be recognized by those of ordinary skill in the art.

Figure 4:
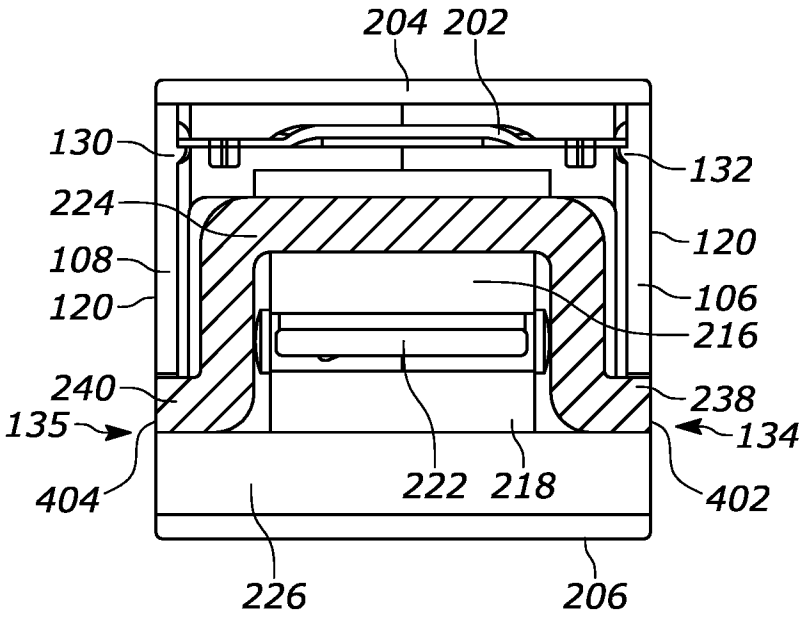
FIG. 4 is a cross-sectional view of the acoustic receiver shown in FIG. 3.
Figure 3:
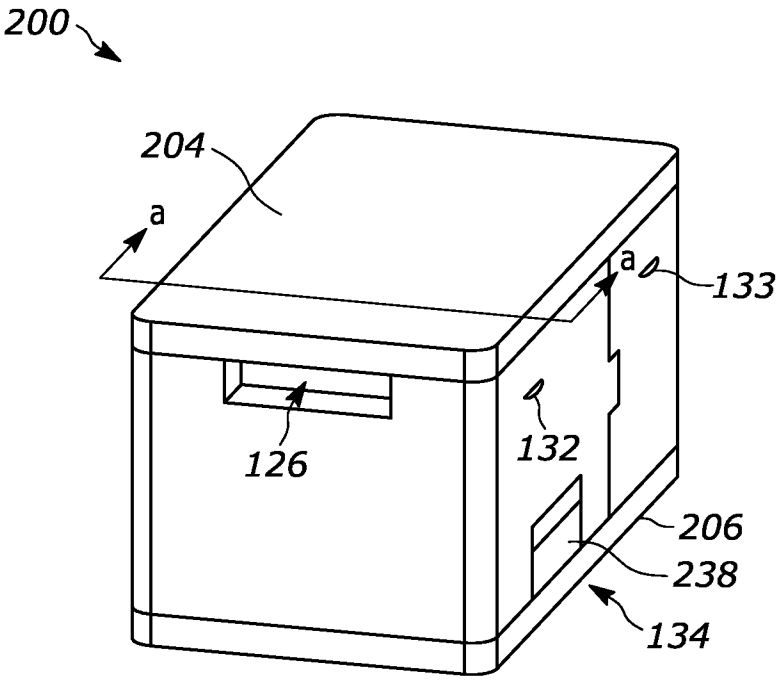
FIG. 3 is an assembled view of the acoustic receiver shown in FIG. 2.

FIG. 3 illustrates the acoustic receiver after assembly with the first receiver subassembly and the second receiver subassembly. As shown in this example, the flanged portion 238 extends to an edge of the bottom housing plate 206 and the closed-ended housing sidewall 100. FIG. 4 shows a cross-section of the assembled acoustic receiver along lines a-a. An edge 402 of the flanged portion 238 is aligned with the outside surface 120 of the first sidewall portion 106. Similarly, an edge 404 of the flanged portion 240 is aligned with the outside surface 120 of the second sidewall portion 108. In other embodiments, however, the edges 402, 404 may extend or protrude beyond the outside surface 120. The sidewall openings can be sealed with an acoustic sealant or other suitable material for applications where back volume venting is not desired.

Figure 6:
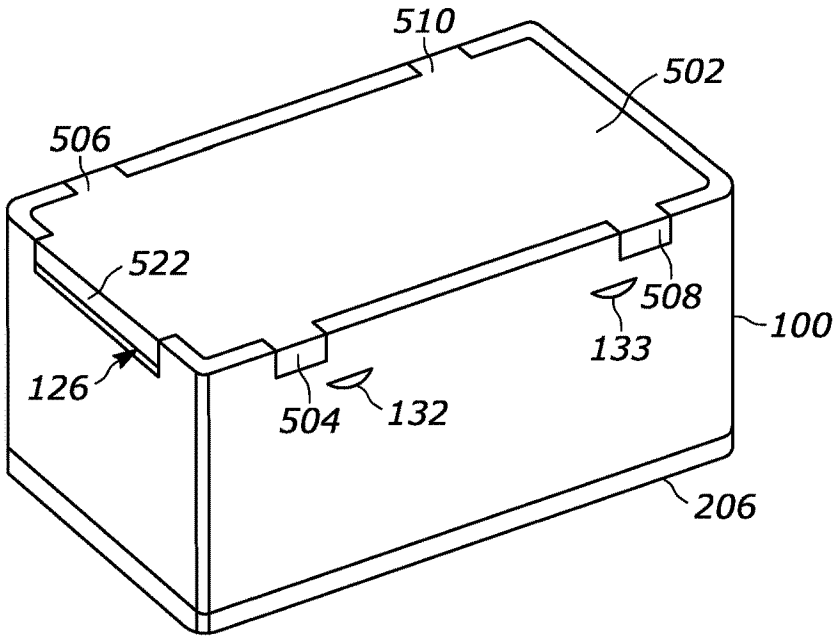
FIGS. 5-6 are perspective views of another acoustic receiver housing in accordance with one example.
Figure 5:
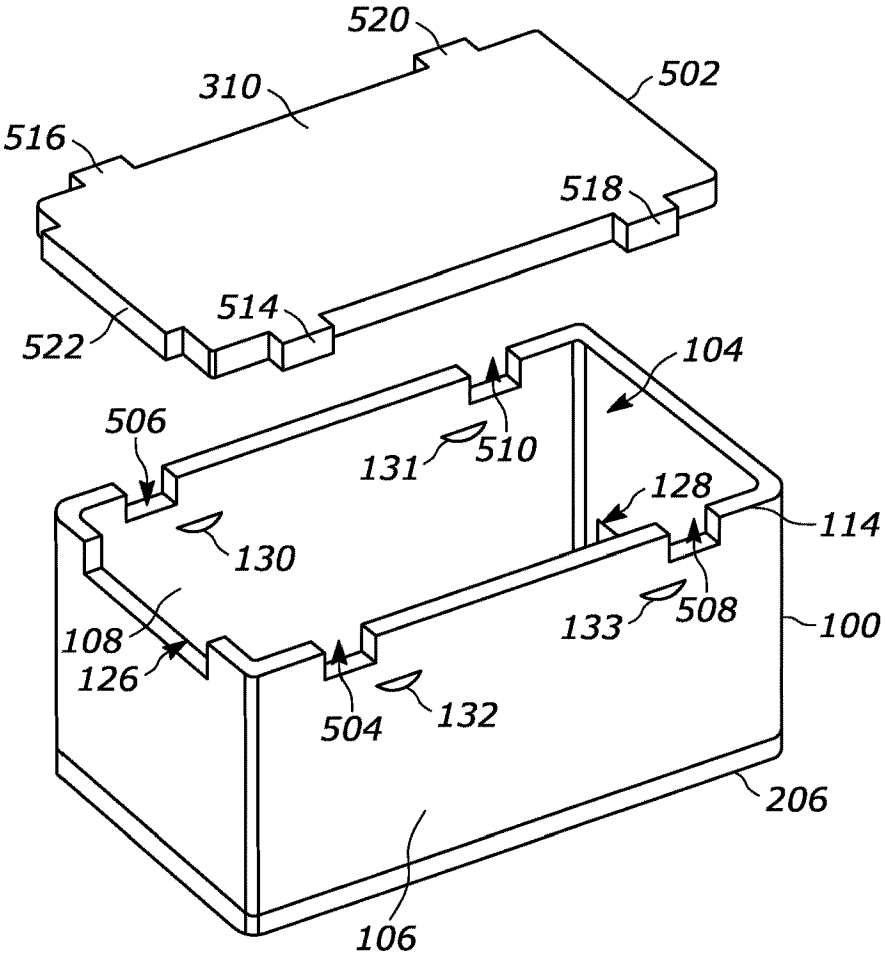

FIGS. 5 and 6 show another embodiment of the acoustic receiver that uses a different top housing plate 502. In this embodiment, the closed-ended housing sidewall has sidewall openings at the top edge 114. In particular, a first sidewall opening 504 is formed in the first sidewall portion 106, and a second sidewall opening 506 is formed in the second sidewall portion 108. Further, a third and fourth sidewall openings 508, 510 are formed in the first and second sidewall portions 106, 108, respectively. The sidewall openings 504-510 are located between the top edge 114 and the diaphragm-support member, shown as projections 130-133 in FIGS. 5 and 6. While FIG. 5 shows rectangular sidewall openings, other suitable shapes and geometries may be used in other embodiments.

In FIGS. 5-6, the sidewall openings 504-510 are configured to receive corresponding tabs 514-520 of, and provide support for, the top housing plate 502. Once assembled, the sidewall openings 504-510 can be sealed by an acoustic sealant or other suitable material. The shape and geometry of the side tabs 514-520 are configured to fit or conform to the shape and geometry of the sidewall openings 504-510. In other embodiments, the top housing plate is formed by a drawn cup portion that is disposed on, and fastened to, the sidewall. Such fastening may be by welds or other fastening means.

In FIGS. 5 and 6, the top housing plate 502 also includes an acoustical port tab 522 placed over the acoustical port 126 to cover at least a portion of the acoustical port 126. The width of the acoustical port tab 522 conforms to the width of the acoustical port 126. The height of the acoustical port 126 can vary according to how much opening is desired. Further, while FIG. 5 shows the acoustical port 126 and the acoustical port tab 522 as rectangular, other suitable shapes (e.g., an arch) may be employed in other embodiments. In embodiments where the top housing plate is a cup, the acoustical port may be disposed alternatively in the cup. FIG. 6 shows the plurality of side tabs positioned in the sidewall openings 504-510 to cover the open top portion 104 of the closed-ended housing sidewall. Unlike prior designs, the sidewall openings 504-510 in FIGS. 5-6 enable a top cover plate with tabs 514-520 to be precisely aligned, easily assembled, and reduce the overall height of the closed-ended housing sidewall. Other advantages will be recognized by those of ordinary skill in the art.

Figure 8:
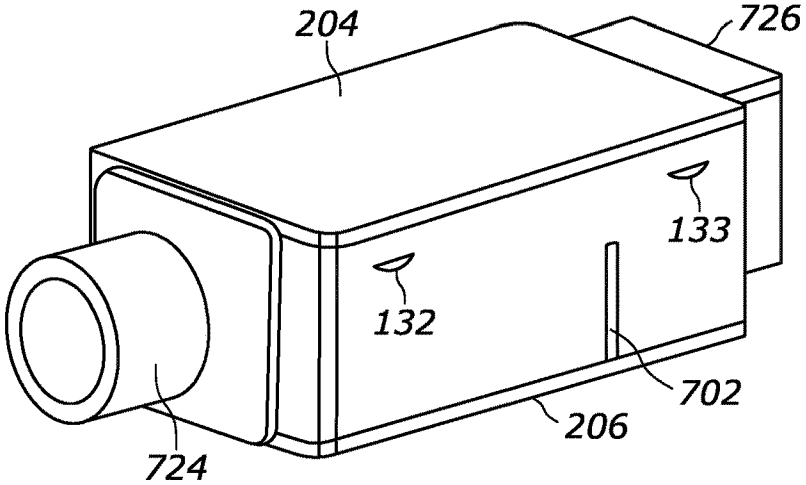
FIGS. 7-8 are perspective views of another acoustic receiver housing in accordance with another example.
Figure 7:
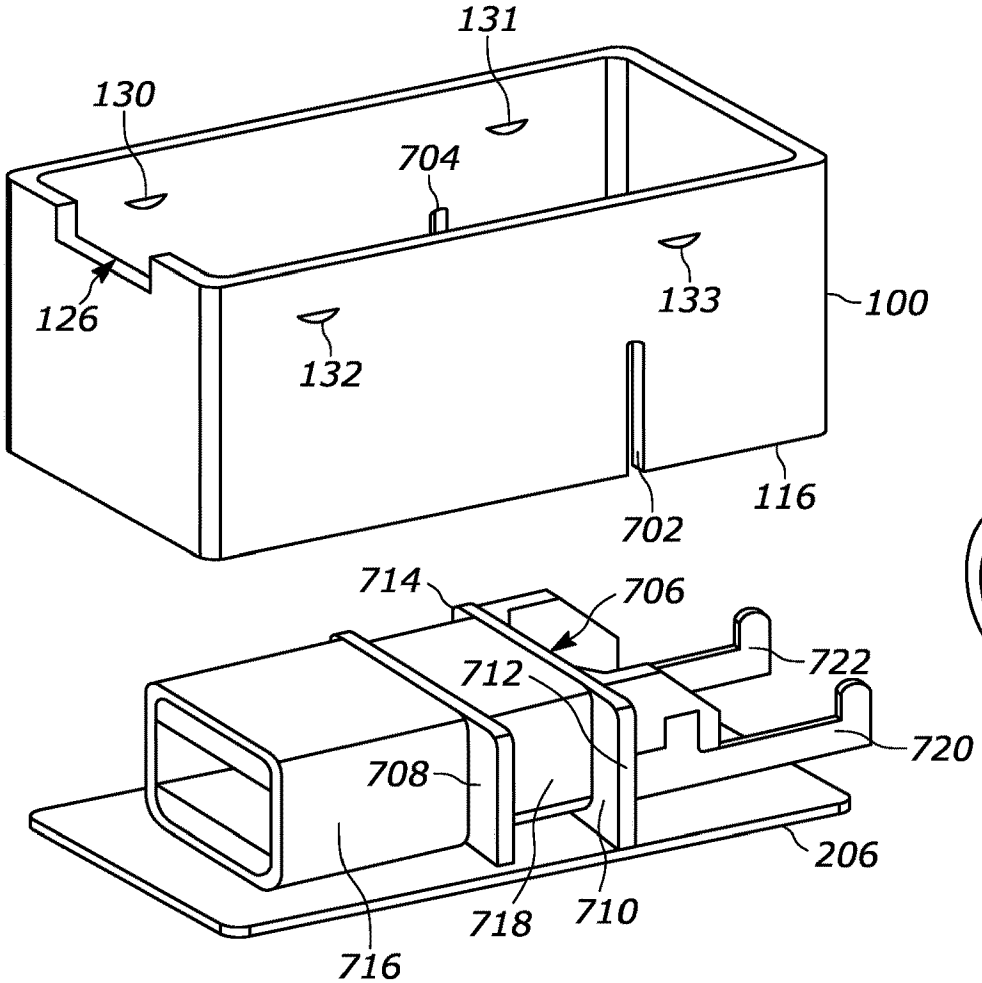

FIGS. 7 and 8 show another embodiment of the acoustic receiver wherein the closed-ended housing sidewall 100 has sidewall openings 702, 704 defined on the bottom edge 116. Each of the sidewall openings 702, 704 are configured to receive a portion of a bobbin 706. The bobbin 706 in FIG. 7 has the general form of the bobbin 211 of FIG. 2 except that the second flanged section 710 of the bobbin 706 in FIG. 7 extends to the edge of the bottom housing plate 206. As such, the sidewall openings 702, 704 receive corresponding flanged portions 712, 714 protruding into the sidewall openings.

FIG. 7 also shows a yoke 716, a coil 718, and electrical leads 720, 722. The yoke is in the form of a stamped and folded structure with butt joined ends (not shown) or comprised of stacked and welded plates. While not shown, the acoustic receiver of FIG. 7 also includes other components, such as a reed, a diaphragm, and a top cover.

FIG. 8 shows the assembled acoustic receiver 200 with a nozzle 724 and an optional termination cover 726 for the electrical leads. Unlike prior designs, the sidewall openings 702, 704 in FIGS. 7-8 can serve to locate the bottom plate on which the motor including the bobbin is disposed relative to the sidewall. Acoustic sealing may be provided by applying cement in seam between the sidewall and bottom plate and sidewall openings where necessary. Other advantages will be recognized by those of ordinary skill in the art.

It should be noted that any combination of the sidewall openings described herein may be employed in acoustic receivers that implement a closed-ended housing sidewall. For example, the sidewall openings 504-510 of FIG. 5 along with the top housing plate 502 may be used in conjunction with the sidewall openings 134-135 of FIG. 1. Other arrangements will be recognized by those of ordinary skill in the art.

Figure 9:
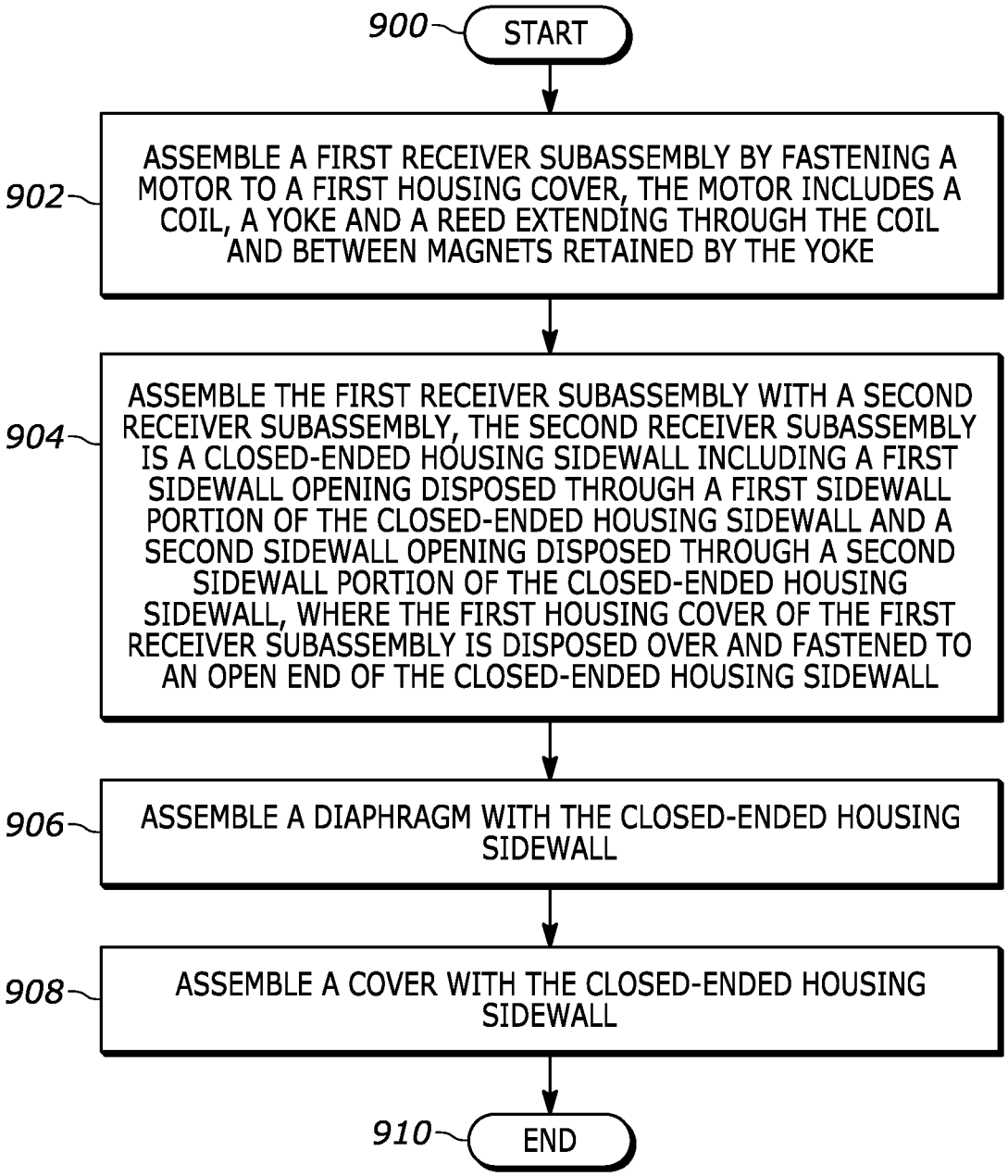
FIG. 9 is a flowchart of a method for assembling an acoustic receiver in accordance with one example.

FIG. 9 illustrates a method for making an acoustic receiver such as the acoustic receiver having a sidewall with openings as described herein. The operations described may be performed manually or using automated assembly machines and fixtures. As shown in FIG. 9, assembly of the acoustic receiver is shown starting in block 900.

In block 902, a motor is disposed on a first housing cover to form a first receiver subassembly. This process may require multiple sub-steps depending on the particular configuration of the motor. For the motor shown in FIG. 2, for example, the yoke plate 226 and magnet 218 are fastened to the cover 206 before the yoke strap portion 224, reed 220 and coil 210 are assembled. In block 904, the first receiver subassembly is assembled with a second receiver subassembly. The second receiver assembly is a closed-ended housing sidewall having a plurality of sidewall openings including a first sidewall opening disposed through a first sidewall portion of the closed-ended housing sidewall and a second sidewall opening disposed through a second sidewall portion of the closed-ended housing sidewall. The first sidewall portion is opposite to the second sidewall portion. The closed-ended housing sidewall may be formed (e.g., folded) from a strip of metal, plastic, carbon fiber, or any other suitable material. Alternatively, the closed-ended sidewall is made by other operations described herein. The plurality of sidewall openings allows a portion of the acoustic receiver to be disposed in the sidewall openings.

In block 906, a diaphragm is assembled with the housing. In some embodiments, the diaphragm is assembled with the closed-ended sidewall portion. In embodiments where the second housing cover is embodied as a cap with a short sidewall portion having diaphragm retention structure, the diaphragm may be assembled with the cap instead of the closed-ended sidewall portion. In some embodiments, the link interconnects the reed and the diaphragm when the diaphragm is assembled with the closed-ended sidewall. In block 908, a cover is assembled with the closed-ended sidewall. In other embodiments where the diaphragm is assembled in the cup portion, the link interconnects the reed and diaphragm when the cup portion is placed on the closed-ended sidewall. Upon assembly of the second cover portion, the diaphragm separates the interior into a front volume and a back volume, wherein the motor is disposed in the back volume. The acoustic receiver is fully assembled by fastening a second housing cover to the closed-ended housing sidewall. Assembly of the acoustic receiver ends in block 910.

While the present disclosure and what is presently considered to be the best mode thereof has been described in a manner that establishes possession by the inventors and that enables those of ordinary skill in the art to make and use the same, it will be understood and appreciated that there are many equivalents to the exemplary embodiments disclosed herein and that myriad modifications and variations may be made thereto without departing from the scope and spirit of the disclosure, which is to be limited not by the exemplary embodiments but by the appended claims.

The invention claimed is:

1. An acoustic receiver comprising:

a first receiver subassembly comprising:

a bottom housing plate; and a motor disposed on the bottom housing plate, the motor including a coil, a yoke retaining first and second magnets, and a reed having a portion located adjacent the coil and extending between the first and second magnets;

a second receiver subassembly comprising a closed-ended housing sidewall having a first open end, the first receiver subassembly and the second receiver subassembly being separate components, the bottom housing plate being coupleable to the closed-ended housing sidewall and covering the first open end of the closed-ended housing sidewall to form at least a portion of a receiver housing, wherein the closed-ended housing sidewall is disposed about the motor when the bottom housing plat is coupled to the closed-ended housing sidewall, the closed-ended housing sidewall defining a plurality of sidewall openings including at least a first sidewall opening disposed through a first sidewall portion of the closed-ended housing sidewall and at least a second sidewall opening disposed through a second sidewall portion of the closed-ended housing sidewall, the first sidewall portion being opposite to the second sidewall portion, wherein the at least first and second sidewall openings receive corresponding portions of the yoke when the bottom housing plate is coupled to the closed-ended housing sidewall;

a diaphragm separating an interior of the receiver housing into a front volume and a back volume when the diaphragm is disposed in the receiver housing, wherein the motor is disposed in the back volume; and a link interconnecting a movable portion of the reed with a movable portion of the diaphragm, wherein the reed is movable between the first and second magnets in response to an excitation signal applied to the coil.

2. The receiver of claim 1, wherein the at least first and second sidewall openings are formed at a bottom edge of the closed-ended housing sidewall, the bottom edge being proximate the bottom housing plate, each of the at least first and second sidewall openings having a width greater than a height of the openings.

3. The receiver of claim 1, further comprising a top housing plate, the closed-ended housing sidewall having a second open end opposite the first open end, the top housing plate fastened to the second open end of the closed-ended housing sidewall, wherein corresponding portions of the top housing plate are disposed in the at least first and second sidewall openings.

4. The receiver of claim 3, wherein the at least first and second sidewall openings are formed at a top edge of the closed-ended housing sidewall, and the top housing plate includes corresponding tabs disposed in the at least first and second sidewall openings.

5. An acoustic receiver housing sidewall subassembly comprising:

a single strip of metal that includes a first end and a second end coupled by a joint to form a closed-ended receiver housing sidewall;

an acoustical port disposed through a first portion of the closed-ended receiver housing sidewall;

a sidewall opening disposed through a portion of the closed-ended receiver housing sidewall, wherein the sidewall opening receives a portion of an acoustic receiver when the subassembly is integrated with other components of the acoustic receiver;

diaphragm-support member protruding from an inside surface of the closed-ended receiver housing sidewall, the acoustical port disposed on one side of the diaphragm-support member and a lead pass-through opening is disposed on an opposite side of the diaphragm-support member.

6. The subassembly of claim 5, wherein the sidewall opening is configured to receive a portion of a yoke when the subassembly is integrated with a motor comprising the yoke.

7. The subassembly of claim 6, wherein the sidewall opening is formed at a bottom edge of the closed-ended receiver housing sidewall.

8. The subassembly of claim 5, wherein the sidewall opening is configured to receive a portion of a top housing plate when the subassembly is integrated with the top housing plate.

9. The subassembly of claim 8, wherein the sidewall opening is formed at a top edge of the closed-ended receiver housing sidewall.

10. The subassembly of claim 8, the closed-ended receiver housing sidewall including two opposite wall portions, a first wall portion including at least a first opening and a second wall portion including at least a second opening, wherein the at least first and second sidewall openings are adapted to receive corresponding portions of the top housing plate when the subassembly is integrated with the top housing plate.

11. The subassembly of claim 5, wherein the sidewall opening is configured to receive a portion of a bobbin when the subassembly is integrated with a motor comprising the bobbin.

12. The subassembly of claim 11, wherein the sidewall opening is formed at a bottom edge of the closed-ended receiver housing sidewall.

13. An acoustic receiver housing sidewall subassembly comprising:

a closed-ended sidewall having first, second, third and fourth sidewall portions, the first sidewall portion opposite the second sidewall portion, and the third sidewall portion opposite the fourth sidewall portion, the closed-ended sidewall having a top edge and a bottom edge, the top edge defining an open top portion of the closed-ended sidewall and the bottom edge defining an open bottom portion of the closed-ended sidewall;

a diaphragm-support structure disposed on the closed-ended sidewall between the top edge and the bottom edge;

an acoustical port disposed through one of the sidewall portions of the closed-ended sidewall, the acoustical port located between the top edge and the diaphragm-support structure;

an opening disposed through a sidewall portion other than the sidewall portion having the acoustical port, wherein the opening is configured to receive a portion of a component of an acoustic receiver when the subassembly is integrated with the component.

14. The subassembly of claim 13, wherein the opening is located between the bottom edge and the diaphragm-support structure, wherein the opening is configured to receive a portion of an acoustic receiver motor when the subassembly is integrated with a motor of the acoustic receiver.

15. The subassembly of claim 14, further comprising a lead pass-through opening disposed through a sidewall portion other than the sidewall portion having the acoustical port, the lead pass-through opening being located between the bottom edge and the diaphragm-support structure.

16. The subassembly of claim 13, the closed-ended sidewall being formed of a strip of material having opposite ends coupled by a joint, wherein the sidewall portions are partly defined by folds in the strip of material.

17. The subassembly of claim 13, wherein the opening is located between the top edge and the diaphragm-support structure, wherein the opening is configured to receive a portion of a top housing plate when the subassembly is integrated with the top housing plate.

18. A method of making an acoustic receiver, the method comprising:

assembling a first receiver subassembly by fastening a motor to a first housing cover, the motor having a coil, a yoke and a reed extending through the coil and between magnets retained by the yoke;

integrating the first receiver subassembly with a second receiver subassembly, the second receiver sub assembly is a closed-ended housing sidewall including a first sidewall opening disposed through a first sidewall portion of the closed-ended housing sidewall and a second sidewall opening disposed through a second sidewall portion of the closed-ended housing sidewall, wherein the first housing cover of the first receiver subassembly is disposed over and fastened to an open end of the closed-ended housing sidewall;

locating corresponding portions of the yoke into the first and second sidewall openings when integrating the first receiver subassembly with the second receiver subassembly, wherein the first and second sidewall openings extend to a bottom edge of the closed-ended housing sidewall.

19. The method of claim 18, further comprising locating portions of a bobbin about which the coil is disposed yoke into the first and second sidewall openings when integrating the first receiver subassembly with the second receiver subassembly, wherein the first and second sidewall openings extend to a bottom edge of the closed-ended housing sidewall.

20. The method of claim 18, further comprising integrating a second housing cover with the second receiver subassembly by locating tabs of the second housing cover into the first and second sidewall openings, wherein the first and second sidewall openings extend to a top edge of the closed-ended housing sidewall.

21. An acoustic receiver comprising:

a first receiver subassembly comprising:

a bottom housing plate; and a motor disposed on the bottom housing plate, the motor including a coil, a yoke retaining first and second magnets, and a reed having a portion located adjacent the coil and extending between the first and second magnets;

a second receiver subassembly comprising a closed-ended housing sidewall having a first open end, the first receiver subassembly and the second receiver subassembly being separate components, the bottom housing plate being connectable to the closed-ended housing sidewall and covering the first open end of the closed-ended housing sidewall to form at least a portion of a receiver housing, wherein the closed-ended housing sidewall is disposed about the motor, the closed-ended housing sidewall defining a plurality of sidewall openings including at least a first sidewall opening disposed through a first sidewall portion of the closed-ended housing sidewall and at least a second sidewall opening disposed through a second sidewall portion of the closed-ended housing sidewall, the first sidewall portion being opposite to the second sidewall portion;

a diaphragm located in the receiver housing, the diaphragm separating an interior of the receiver housing into a front volume and a back volume, wherein the motor is disposed in the back volume; and a link interconnecting a movable portion of the reed with a movable portion of the diaphragm, wherein the reed is movable between the first and second magnets in response to an excitation signal applied to the coil; and the motor further comprising a bobbin about which the coil is disposed, wherein corresponding portions of the bobbin protrude into the at least first and second sidewall openings when the first subassembly is connected to the second subassembly.

22. The receiver of claim 21, wherein the at least first and second sidewall openings are formed at a bottom edge of the closed-ended housing sidewall, the bottom edge being proximate the bottom housing plate, each of the at least first and second sidewall openings having a height greater than a width of the openings.

* * * * *